US005227265A

United States Patent [19]

DeBoer et al.

[11] Patent Number: 5,227,265

[45] Date of Patent: Jul. 13, 1993

[54] MIGRATION IMAGING SYSTEM

[75] Inventors: Charles D. DeBoer, Irondequoit; Dennis R. Kamp, Spencerport; William Mey, Greece, all of N.Y.

[73] Assignee: Eastman Kodak Company, Rochester, N.Y.

[21] Appl. No.: 673,509

[22] Filed: Nov. 30, 1990

[51] Int. Cl.[5] ..... G03G 13/048

[52] U.S. Cl. ..... 430/41; 430/44; 430/126; 430/944; 430/348; 250/316.1; 250/317.1; 250/318

[58] Field of Search ..... 430/41, 944, 348, 44, 430/130, 126; 250/316.1, 317.1, 318; 101/401.1

[56] References Cited

U.S. PATENT DOCUMENTS

| | | | |
|---|---|---|---|
| 3,410,203 | 11/1968 | Fischbeck . | |
| 3,574,657 | 4/1971 | Burnett | 430/944 |
| 3,723,113 | 3/1973 | Goffe | 430/41 |
| 3,780,214 | 12/1973 | Bestenreiner et al. . | |
| 3,798,030 | 3/1974 | Gundlach | 430/41 |
| 3,833,441 | 9/1974 | Heiart | 250/317.1 |
| 3,836,364 | 9/1974 | Lin | 430/41 |
| 4,123,283 | 10/1978 | Goffe | 430/41 |
| 4,123,578 | 10/1978 | Perrington et al. | 428/206 |
| 4,125,322 | 11/1978 | Kaukeinen et al. | 355/4 |
| 4,139,853 | 2/1979 | Ghekiere et al. | 346/1 |
| 4,148,057 | 4/1979 | Jesse | 358/4 |
| 4,252,890 | 2/1981 | Haas et al. | 430/348 |
| 4,494,865 | 1/1985 | Andrus et al. . | |
| 4,536,457 | 8/1985 | Tam . | |
| 4,536,458 | 8/1985 | Ng . | |
| 4,542,084 | 9/1985 | Watanabe | 430/46 |
| 4,626,868 | 12/1986 | Tsai . | |
| 4,711,834 | 12/1987 | Butters | 430/201 |
| 4,883,731 | 11/1989 | Tam et al. . | |
| 4,942,110 | 7/1990 | Genovese et al. | 430/198 |

FOREIGN PATENT DOCUMENTS

87/03249 12/1987 PCT Int'l Appl. .

OTHER PUBLICATIONS

"Xeroprinting Master with Improved Contrast Potential" by Robert W. Gundlach, Xerox Disclos. Journal, vol. 14, No. 4, Jul./Aug. 1989, pp. 205-206.

"Printing by Means of a Laser Beam" by D. D. Roshon, Jr. and T. Young, IBM Technical Disclosure Bulletin, vol. 7, No. 3, Aug. 1964.

*Primary Examiner*—Marion E. McCamish
*Assistant Examiner*—Christopher D. RoDee
*Attorney, Agent, or Firm*—David A. Howley

[57] ABSTRACT

A migration imaging system using a laser-addressable thermoplastic imaging member. The imaging member comprises a supporting section and a thermoplastic imaging surface layer. A charged, uniform layer of marking particles is deposited on the imaging surface layer. An imagewise-modulated laser beam transforms selected volumes of the imaging surface layer in an imagewise pattern to a permeable state. Charged marking particles that superpose a transformed volume then migrate into the imaging surface layer so as to be retained. Unaddressed marking particles are cleaned away. The imaging member, or solely the imaging surface layer, may be transferred and bonded to a receiver such as a drum for use as an exposure mask, or to a receiver sheet to provide a hard copy reproduction. The processed imaging member is usable as a master in a xeroprinting system.

17 Claims, 8 Drawing Sheets

FIG. 5
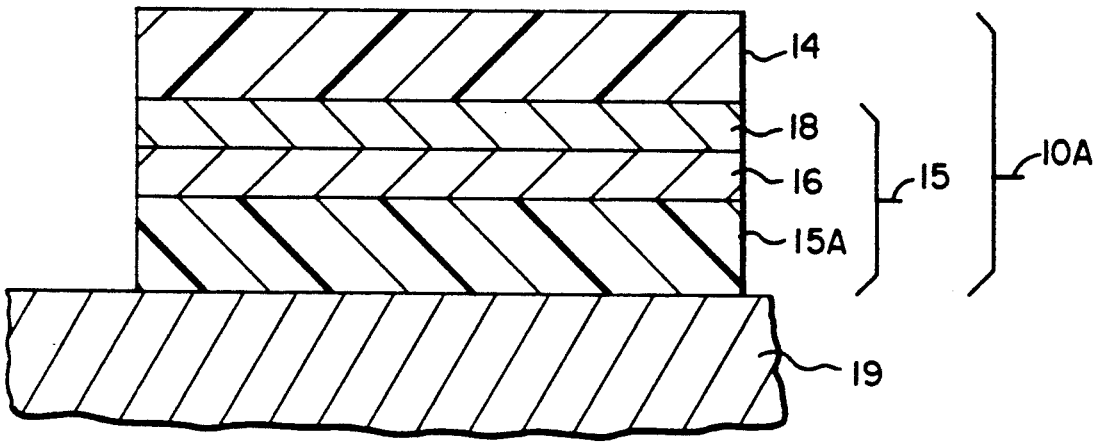
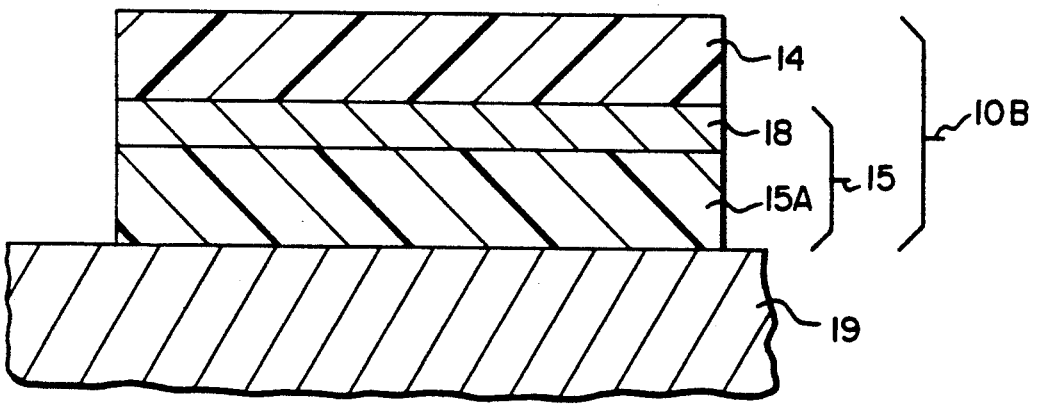
FIG. 6

MIGRATION IMAGING SYSTEM

CROSS-REFERENCE TO RELATED APPLICATION

This application is related to co-pending U.S. patent application Ser. No. 621,691, now abandoned, filed in the name of DeBoer et al. concurrently herewith.

BACKGROUND OF THE INVENTION

1. Field of the Invention

This invention relates generally to an imaging system, and specifically to an improved migration imaging system utilizing an imaging member having a thermoplastic imaging surface layer.

2. Description of the Prior Art

Within the art of electrophotography are imaging processes or systems which involve the migration of particles in a liquid or softenable medium to achieve an imagewise pattern. Particle migration to provide a latent image has been disclosed, for example, in processes based upon electrophoretic and photoelectrophoretic imaging of photoconductive particles dispersed in liquids. In solid mediums that are nominally not permeable, particle migration is typically facilitated by the softening of the medium by the application of heat or solvents.

Most conventional migration imaging systems will arrange the marking particles in an imagewise pattern on the softenable member before any migration is accomplished. Thus, some means must be provided for composing the particles in an image-wise pattern, and another means may be necessary to transfer the pattern to a softenable layer. Then, a further means is used to soften the layer, and another means is used to migrate the particles into the softened layer. The system is complicated and the process is time-consuming. A simpler and more efficient system is desired.

Some migration imaging systems utilize a solid migration imaging member which typically comprises a substrate, a layer of softenable material, and a layer of photosensitive marking material deposited on the softenable layer. A latent image is formed by electrically charging the member and then exposing the member to an imagewise pattern of light to discharge selected portions of the marking material layer. The entire softenable layer is then made permeable by dissolving, swelling, melting, or softening it by application of heat or a solvent, or both. Portions of the marking material that retain a differential residual charge due to the light exposure will migrate into the softened layer by electrostatic force. One example of such an imaging process is disclosed in U.S. Pat. No. 4,883,731, issued to Tam et al.

An imagewise pattern may also be composed in a solid imaging member by establishing a differential in the density of colorant particles in imaged vs. non-imaged areas. In other words, the colorant particles are uniformly dispersed and then selectively migrated such that they are further dispersed to a greater or lesser extent. The differential density determines the image. The overall quantity of particles on the substrate is unchanged. Alternatively, the particles are migrated such that certain particles agglomerate or coalesce, thus achieving a differential density.

Or, in what is known as a heat development method, a solid imaging member will include colloidal pigment particles dispersed in a heat-softenable resin film on a transparent conductive substrate. An electrostatic image is transferred to the film, which is then softened by heating. The charged colloidal particles migrate to the oppositely charged image. Image areas are thereby increased in particle density while the background areas are less dense. Heat development is described by Schaffert, R. M., in *Electrophotography*, (Second Edition, Focal Press, 1980) at pp. 44–47 and, in particular, in U.S. Pat. No. 3,254,997.

However, the images formed in the solid imaging members processed according to the foregoing approaches have been found to lack the image contrast, gray scale accuracy, and sharp resolution required in high-resolution image reproduction. A simpler and more efficient imaging system would be desirable.

In another imaging process known generally as adhesive transfer, a solid, multilayered donor-acceptor imaging member is used to produce image copies. The donor layer includes a uniform fracturable layer of marking particles, a marking particle release layer, and a supporting carrier or sheet. An adhesive-coated acceptor layer overlies the marking particle layer. Areas of the marking particles are softened by localized heating in an imagewise pattern such that their attraction to, or retention by, the donor portion is less than the attraction of particles to non-heated areas. The acceptor layer may then be stripped from the member, taking the imaged pattern of marking particles from the release layer.

The aforementioned adhesive-transfer systems operate on a frangible dispersion of marking particles under a separable adhesive layer. Such systems typically cannot offer high resolution image reproductions because of an inherent compromise between the frangibility of the particles in non-imaged areas vs. the cohesiveness of particles in an imaged area. For example, in a peel-away system, any imaged area of the particulate layer must be cohesive enough to be carried with the peel-away layer. However, the imaged area must break cleanly at a border with a non-imaged area. Serifs, fine lines, dot images, and the like can receive an undesirably ragged edge during such a process.

For example, International Patent Application WO 88/04237, filed Dec. 7, 1987 by Polaroid Corporation, discloses a thermal imaging medium which includes a support sheet having a surface of a heat-liquifiable material and a layer of a particulate or porous image-forming substance. A pressure-sensitive adhesive layer overlies the particulate layer. The liquifiable material is imagewise exposed to heat to cause it to flow by capillary action into the image-forming substance. With cooling, the imaged areas of the substance are thereby retained by the material on the support sheet. The adhesive layer is then peeled away, causing the unexposed areas of the particulate layer to break from the exposed areas and be carried with the adhesive layer. The support sheet retains the exposed pattern.

However, the fracturing between exposed and unexposed areas can be uneven or irregular. Moreover, the heat-softened material is expected to flow only into a certain volume of the colorant, but the flow is not restricted. The softened material can flow laterally into a volume that is adjacent the heated area and which is not part of the image to be reproduced. The perimeter of an image component (a dot, for example) would then be greater than intended. As a result, image quality can be degraded.

In general, adhesive transfer and migration imaging systems are also materials-intensive and thus are costly to operate. This is especially so in systems which consume materials that are not provided in a simple, easy-to-use, and inexpensive form.

Significant waste products are generated in many of the above-described systems. Solvent-based systems generate a solvent effluent that is hazardous, expensive to discard, and cumbersome. Adhesive transfer systems generate discarded peel-away films which are usually not reusable. Proper disposal of such waste is inconvenient and increases operating costs.

Migration imaging and adhesive transfer processes have, therefore, not been favored for image reproduction in a number of applications, especially in high-resolution or high-speed printing.

SUMMARY OF THE INVENTION

It is an object of the present invention to provide an improved imaging system for the production of high-quality, high-resolution image reproductions without the disadvantages found in the prior art imaging systems.

It is a further object of the present invention to provide a versatile imaging system usable for generating image reproductions in the form of monochromatic or multicolor prints, transparencies, xeroprinting masters, exposure masks, graphic printing plates, or color printing proofs.

It is another object of the present invention to provide image reproductions in a simple and efficient apparatus using image data from a rasterized image data source.

It is another object of the present invention to provide image reproductions by use of simple consumable materials such as toner, which may be reused if not consumed.

These and other objects are met by a novel migration imaging system using a thermoplastic imaging member. The imaging member comprises a supporting section and a thermoplastic imaging surface layer.

In the practice of the invention, a charged layer of marking particles, such as toner, is deposited on the imaging surface layer. The marking particles are thereby subject to an electrostatic attraction to the supporting section. The imaging member is selectively exposed to heat-inducing energy, such as a scanning infrared beam, in an imagewise pattern. The applied energy transforms selected portions of the imaging surface layer to a permeable state.

The charged marking particles that superpose the transformed portions then migrate into the imaging surface layer so as to be retained by the surface layer. In some applications, the addressed particles are also tacked together due to the applied energy. Unaddressed marking particles are cleaned away.

The imaging member may then be used simply as a hard copy image in the form of a reflection copy, a transparency, or as an image master. Alternatively, the imaging member may be transferred and attached at its imaging surface layer to a receiver means, such as a web or transfer drum, or to a receiver sheet, such as a film sheet or paper sheet. In another embodiment, the imaging surface layer is separable from the imaging member and attachable to a receiver means or to one or more receiver sheets.

A set of color separation images of good contrast ratio, high resolution, and high image quality may be written on one imaging member. The images may be written in series, and a set of hard copy color separations may be generated for use as, for example, color separation proofs. Alternatively, the color separations may be transferred in superposition to a single receiver to generate a composite color print.

An imaging system according to the invention is envisioned for use in direct digital color proofing, wherein near-photographic quality prints may be generated at higher speed and lower cost than by conventional methods such as thermal dye transfer. Pigments or ink particles to be used in the lithographic printing run may be used as the marking particles in generating a color proof. The resulting color proof has better color accuracy and therefore is more valuable than those provided by conventional processes.

The contemplated imaging member is formed of simple materials that are inexpensive and easy to handle. No solvents are required and virtually no waste is generated in the imaging process. In fact, the unaddressed marking particles may be reserved for subsequent imaging.

The imaging member is especially compatible with a conventional laser scanner because the aforementioned selective exposure to heat-inducing energy may be provided by a scanning laser beam modulated by a rasterized data stream. Image information may be provided to the scanner and recorded in the thermoplastic imaging surface layer at a high data rate. The contemplated imaging member also may be thermally biased so as to be exposable by a scanning beam moving at an especially high scan rate, which further enhances the speed and efficiency of the imaging process.

The imaging surface layer may be attached to papers that normally do not retain a toned image. Alternatively, the supporting section may be paper whereby no transfer of the processed imaging surface layer is needed. Thus, hard copy reproductions may be produced on, or transferred to, a variety of papers or films that are not usable in the typical copier due to their weight, moisture content, surface layer texture or irregularity, electrical resistance, or other characteristics. The imaging surface layer, when transferred, also provides a more uniform gloss to the receiver.

One preferred application of the imaging member is in the production of high-quality hard copy images for the graphics arts industry and for diagnostic imaging equipment, such as ultrasonic, radiographic, and nuclear medical imaging devices. Such equipment is increasingly incorporated in large-scale digital picture-archiving and communication systems used in medical and other scientific research institutions.

In another preferred embodiment, the supporting section of the imaging member comprises a film base having photoconductive constituents. The imaging surface layer, after having an imagewise pattern of marking particles migrated therein, may be illuminated. Light not obscured by the marking particles will then discharge the film base in an imagewise pattern. The resulting latent image may then be developed and transferred to a receiver according to known xeroprinting methods.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings.

FIG. 5 is a side sectional view of the imaging member of FIGS. 1–4 on a support.

FIG. 6 is a side sectional view of an alternative embodiment of the imaging member of FIG. 5.

DETAILED DESCRIPTION OF THE PREFERRED EMBODIMENT

Figure 1:
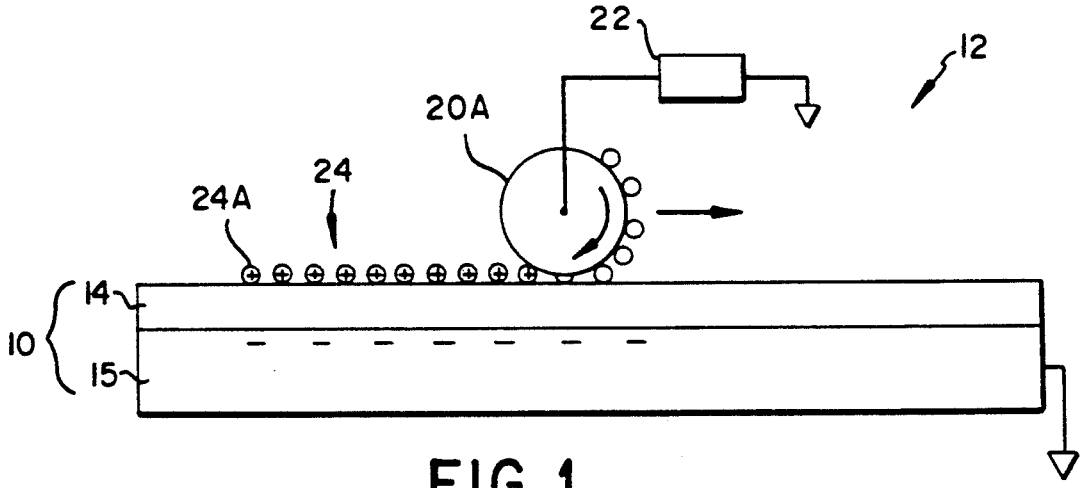
FIG. 1 is a side schematic view of a migration imaging system using a novel imaging member constructed according to the present invention. The imaging member is illustrated during the step of deposition of marking particles on the imaging member.

As illustrated in FIGS. 1–4, a novel thermoplastic imaging member 10 is processed in a migration imaging system 12 constructed according to the invention. As shown in FIG. 1, a thermoplastic imaging surface layer 14 receives a marking particle layer 24 deposited by a particle deposition means 20A such as a biased magnetic brush connected to a bias voltage supply 22. The particle deposition means 20A is equipped with a quantity of marking particles which are then deposited on the imaging surface layer 14 as the means 20A passes over the imaging surface 14.

A supporting section 15 of the imaging member 10 is connected to one potential of the bias voltage supply 22 such that an electrostatic field is established between the marking particle layer 24 and the supporting section 15 according to known bias development techniques. The marking particle layer 24 is attracted to the imaging surface layer 14 by virtue of the electrostatic attraction of the individual particles 24A to the imaging member 10. Alternatively, the marking particles may be first uniformly deposited and then charged by known techniques to cause them to be attracted to the imaging surface layer 14.

Although the marking particle layer 24 is illustrated for clarity as being a single layer of positively charged particles 24A, in practice, the layer is several particles deep. The polarities of the marking particle layer 24 and the supporting section 15 may in the alternative be reversed, depending upon the application.

Preferably, the marking particles 24A are dry pigmented toner particles. Suitable toner formulations are disclosed in U.S. Pat. No. 4,546,060, issued to Miskinis et al. on Oct. 8, 1985, the content of which is incorporated herein by reference. Preferably, a matrix of thermoplastic pigmented particles are mixed with hard magnetic carrier particles to form a two-component developer usable by a magnetic brush.

Common magnetic brush systems include one system consisting of a fixed magnetic core with a rotating nonmagnetic shell. Another common system is a rotating magnetic core with a rotating or nonrotating shell. The magnetic core is constructed of similar strength magnets that are arranged in an alternate pole fashion.

In the fixed magnetic core system, material is pulled tightly to the surface of the shell. As the shell rotates, it pushes material from one magnetic region to another. The material lines up in long chains perpendicular to the shell surface and flips very quickly at the pole transitions. The alignment of particles at any given location around the core axis remains constant and dependent on the local magnetic field configuration. In the rotating magnetic core system, chains of material are in a state of constant flipping action as they traverse around the surface of the shell. This motion delivers a large amount of marking particles to the image member.

Suitable carrier formulations and magnetic brush development means are disclosed in U.S. Pat. No. 4,546,060, issued to Miskinis et al. on Oct. 8, 1985; U.S. Pat. No. 4,473,029, issued to Fritz et al. on Sep. 25, 1984; and U.S. Pat. No. 4,531,832, issued to Kroll et al. on Jul. 30, 1985, the contents of which are incorporated herein by reference.

It is contemplated that other electrostatically-chargeable marking particles, such as dye particles, single-component developers, pigmented graphics art inks, or liquid toners may be uniformly deposited by other appropriate deposition means known in the art.

Figure 2:
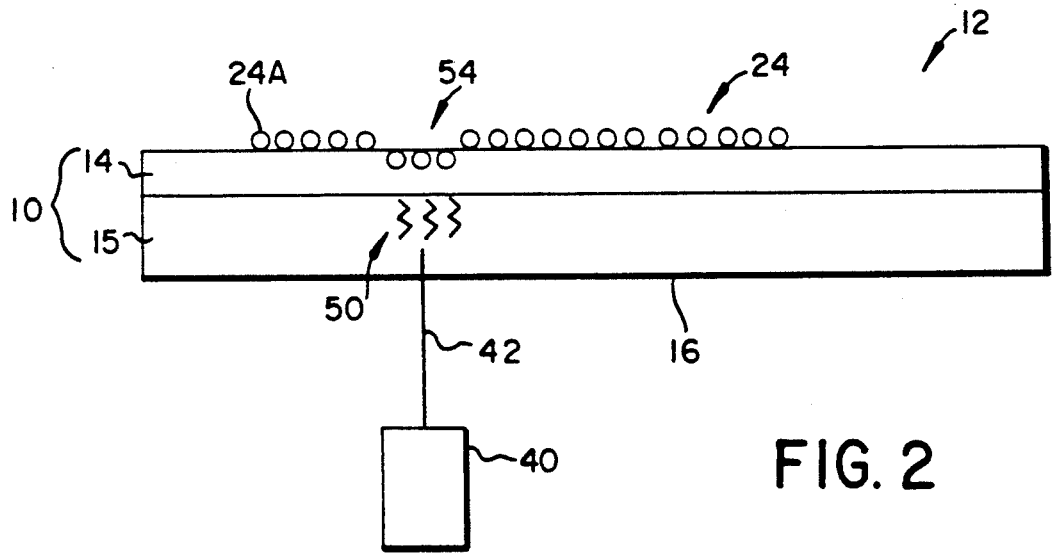
FIGS. 2 and 3 are side schematic views of the imaging system of FIG. 1 during the steps of imagewise exposure and cleaning, respectively, of the thermoplastic imaging surface layer on the imaging member.

As shown in FIG. 2, the imaging member 10 is exposed to imagewise-modulated heat-inducing energy. Preferably, the exposure is accomplished by a modulated scanning light beam 42 provided by an beam scanner 40. The scanning beam 42, which in a particularly preferred embodiment is an infrared laser beam, may be directed from scanner 40 through either side of the imaging member 10 to one of several components of the imaging member 10. For example, the beam 42 may be focussed through the supporting section backside 16 to heat the supporting section, or may be focussed deeper, at the thermoplastic layer 14. Alternatively, the beam 42 may be directed onto the marking particle layer 24 whereupon the exposed particles absorb the incident radiation and are heated, and whereupon the heat so generated is conducted to the underlying thermoplastic layer 14. Finally, the beam 42 may be directed through the marking particle layer 24 to heat the thermoplastic layer 14 if the marking particles in layer 24 are substantially non-absorptive of the scanning beam.

Those skilled in the art will recognize that the selection of the beam focal point is determined according to several factors such as the wavelength of the incident beam and the materials that constitute the imaging member 10 and the particle layer 24. Many formulations of non-carbon toner, for example, are non-absorptive at infrared wavelengths. Whether the focal point is selected as being in the supporting section 15, the imaging surface layer 14, or the marking particle layer 24, the object of the exposure is to establish (by direct radiation or by conduction) a selectively-intensive amount of heat within a minute volume, or pixel 50, of the imaging surface layer 14.

The beam 42, in addition to being modulated according to the image data to be recorded, is also line-scanned across the imaging member. The contemplated exposure to heat-inducing energy heats a succession of pixels 50 in the imaging member 10. At each exposed pixel there is a respective localized state change, or transformation, of the imaging surface layer 14. That is, the imaging surface layer becomes selectively permeable by the superposed marking particles 54, according to the amount and location of the heat that it receives. The exposure of pixels in the imaging surface layer to effect the desired transformation is characterized as addressing.

The marking particles 54 that superpose a transformed pixel (such particles hereinafter characterized as addressed particles) will be subject to migration into the imaging surface layer 14 under the influence of their electrostatic attraction to the supporting section 15. In applications which use thermoplastic marking particles, it is further contemplated that the induced heating will be sufficient to also tack the addressed particles 54 together. Nonetheless, the pixel exposure is brief such that the addressed marking particles soon harden into a coherent group, and the transformed volume regains a substantially non-permeable state. Adjacent, unaddressed marking particles 56 remain undisturbed on the imaging surface layer 14.

Relative movement between the beam 42 and the imaging member 10 in the cross-scan direction thereby provides a full image frame exposure. In the illustrated embodiment, the particle deposition means 20A is moved relative to the imaging member 10. The scanning beam 42 may be advanced in the cross-scan direction such that the scanning beam "trails" the particle deposition means 20A as an advancing edge of the marking particle layer 24 is deposited. In other embodiments, the imaging member 10 may be moved past a stationary particle deposition means 20A; the scanning beam 42 then does not necessarily include a cross-scan motion component.

Generally, a chosen set of plural line scans will constitute what may be considered as an exposure of one image frame. If desired, the modulation of the beam may be such that the line scanning provides a series of image frames that are sequentially exposed, with each exposed image frame being separated from a previous one by a band of attenuated exposure. The interframe band may be subject to sufficient modulated exposure to provide fiduciary lines, descriptive text, or other information with respect to an adjacent image frame.

A set of image frames may therefore comprise, for example, a color separation set for use in printing a multicolor image. For clarity in the following discussion, however, it will be assumed that one image frame has been written unless otherwise denoted.

Other variations of the above sequence are contemplated; for example, the imaging surface layer 14 may be fully toned before scanning is initiated. Or, in an alternative to the beam scanning exposure in the above, an image frame may be exposed by contact mask exposure of the image member 10 to heat-inducing energy selectively passed through a fixed linear or areal mask. Methods for effecting such mask exposure are known in the art.

Figure 3:
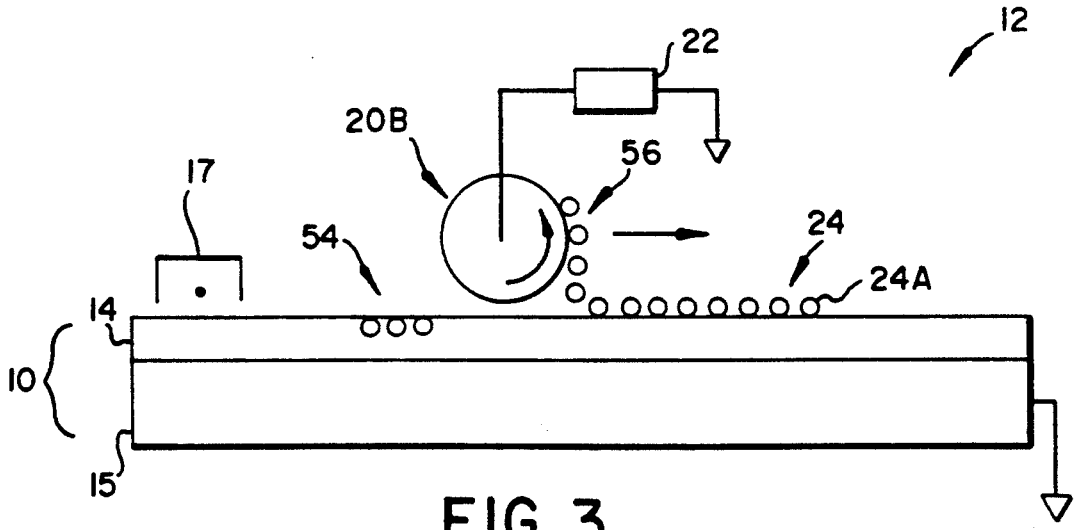

As illustrated in FIG. 3, the image frame is then cleaned of the unaddressed marking particles, leaving only the addressed particles on or in the imaging surface layer 14. Alternatively, the means 20B may clean exposed areas of the image frame while the unexposed areas of the frame are being addressed. Means 20B for electrostatic particle cleaning are generally known in the art; for example, a magnetic brush that is free of marking particles may be passed over the imaging member 10 to pick up the loose particles. Accordingly, it is contemplated that the marking particle deposition and cleaning steps may be performed by a single magnetic brush means, depending on the controlled concentration of marking particles therein. Alternatively, two magnetic brush means may be used, whereby one is charged with marking particles (for deposition) and the other is not charged with marking particles (for cleaning).

The unaddressed marking particles need not be wasted and in fact are reusable. Unaddressed marking particles lifted by the cleaning process are carried by the cleaning means 20B to be ejected into a receptacle for re-use in a future marking particle deposition step. If the marking particle deposition and cleaning steps are performed by a single means, the means may be suitably prepared to deposit marking particles and then be automatically altered in such a way that particles are attracted by the means. For example, a reversal of the biasing field in a magnetic brush is one such alteration.

Thus, to recount the processing steps shown in FIGS. 1–3, after the marking deposition step, the particle deposition means 20A may be withdrawn from the imaging member, scanning exposure is done, and cleaning means 20B is passed over the image frame to remove unaddressed particles 24A. The aforementioned steps may be conducted sequentially over one or more image frames. Alternatively, it is contemplated that first, second, and third areas of one image frame may be respectively and simultaneously undergoing the deposition, exposure, and cleaning steps.

In one preferred embodiment, the imaging member 10 may be transparent such that with little or no further processing, the imaging member 10 may be removed for use as an image transparency or image mask. The pattern of migrated particles forms an image viewable by projection in a fashion similar to that used with a conventional image transparency. The pattern of migrated particles also forms a negative or positive exposure mask usable in the exposure of, for instance, a photosensitive film, web, or printing plate. For example, the image member may be positioned adjacent a charged photoconductor and used as a master image for contact exposure of the photoconductor in an electrostatographic imaging process.

Figure 4A:
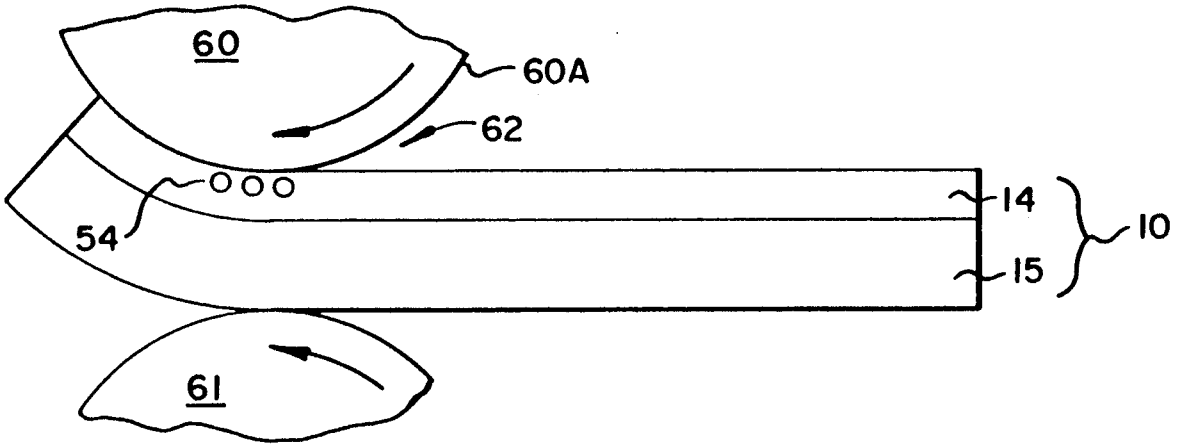
FIG. 4A is a side schematic view of the imaging member of FIG. 3 during transfer of the imaging member to a receiver means.
Figure 4B:
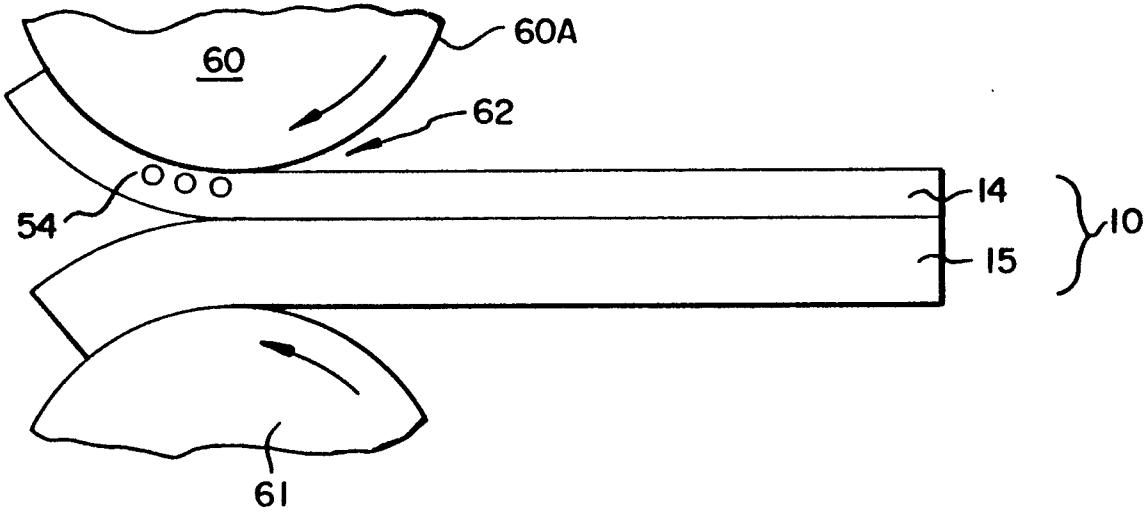
FIGS. 4B and 4C are a side schematic views of the imaging member of FIG. 3 during transfer of the thermoplastic imaging surface layer from the image member to receiver means or a receiver sheet, respectively.
Figure 4C:
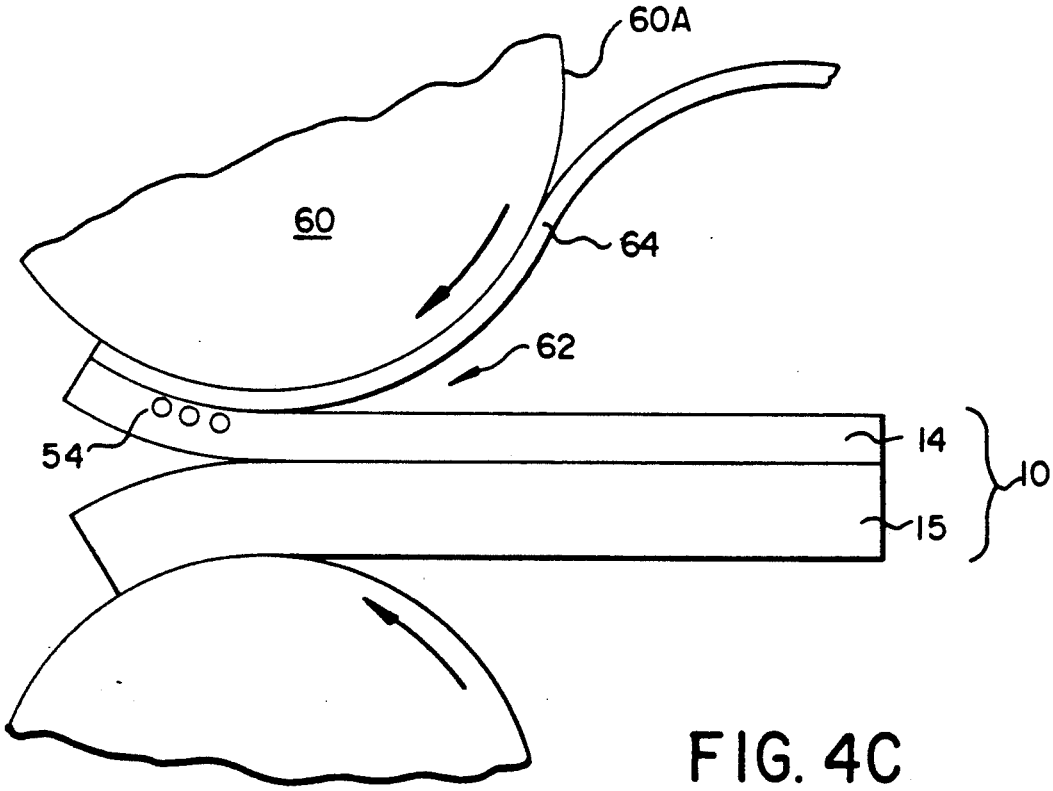
Figure 4D:
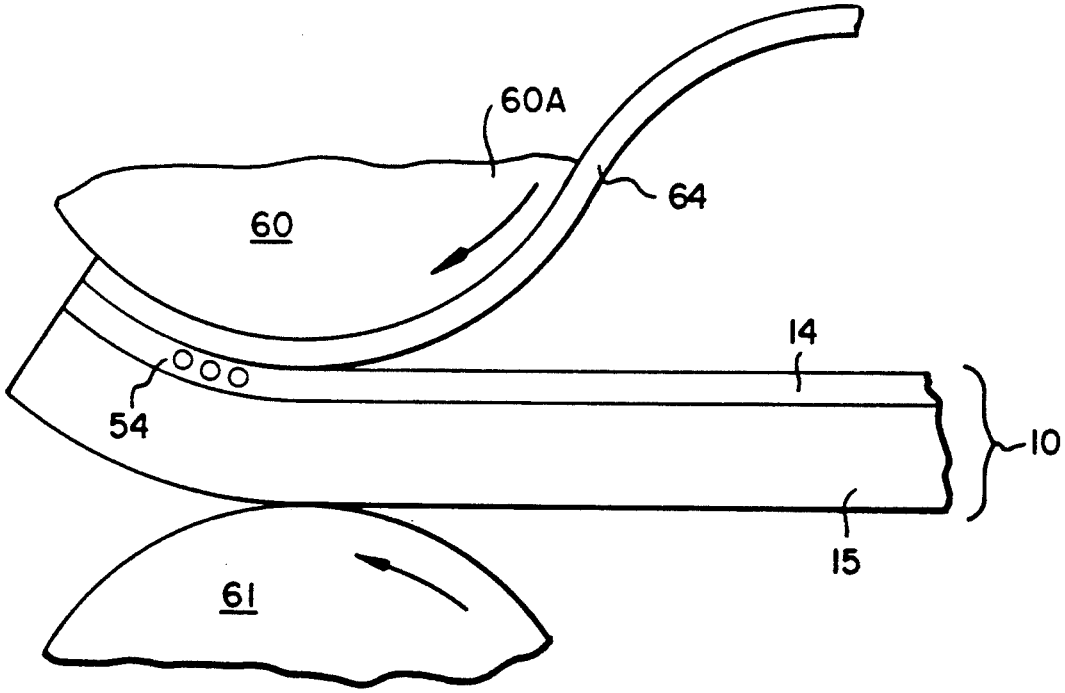
FIG. 4D is a side schematic view of the imaging member of FIG. 3 during transfer of the imaging member to a receiver sheet.

As illustrated in FIGS. 4A–4D, the practice of the invention may continue with additional processing such that the thermoplastic imaging surface layer 14 is bonded to a receiver. Preferably, suitable receivers include receiver means 60, such as a rotatable drum as shown in FIGS. 4A and 4B, or a receiver sheet 64 as shown in FIGS. 4C and 4D.

As shown in FIG. 4A, the surface 60A of the receiver means 60 progressively contacts and momentarily heats a section 62 of the thermoplastic imaging surface layer 14. In contrast to the aforementioned selective exposure to heat-inducing energy shown in FIG. 2, the heat applied in this transfer step effects an overall softening of the interface between the imaging surface layer 14 and the receiver means 60 such that the surface 14 adheres to the receiving surface 60A. Generalized heating at the contact point 62 may be effected by, for example, selective energization of heating elements (not shown) within the receiver means 60 or pressure roller 61.

The step of bonding the entire imaging member 10 to a transparent version of the receiver means 60 is desirable in that the means 60 so equipped is usable as a master in xeroprinting, mask exposure of printing plates, or other projection-based imaging processes. Accordingly, planar versions of receiving means 60 are also contemplated, such as a planographic plate.

Alternatively, as illustrated in FIG. 4C, a receiver sheet 64 is introduced at the contact point 62 to receive the imaging surface 14. The receiver sheet 64 may be a sheet of, for example, photoconductive material, paper, or transparent film stock. The receiver sheet 64 may be predisposed and retained on the receiver means 60 by known sheet-holding means, such as vacuum orifices, until release is necessary.

In the embodiments shown in FIGS. 4B and 4C, the imaging surface layer 14 is softened in the generalized heating step such that it also separates at the contact point 62 from the supporting section 15. Only the imaging surface layer 14 then bonds to the receiver sheet 64 or to the receiver means 60. The supporting section 15 may be removed and discarded or, preferably, set aside for recoating with a new thermoplastic imaging surface layer 14. Thus, the supporting section is reusable.

Known apparatus (not shown) may operate on the imaging surface layer after the cleaning step (illustrated in FIG. 3) so as to fix the addressed marking particles in the image surface. Or, a fixing step may be especially useful in applications where, for example, the imaging surface layer 14 is completely separated and bonded to the receiver means 60 or sheet 64. The receiver sheet 64 may, for example, be a paper sheet stripped from the receiver means 60 and then optionally guided to a fusing station, etc. for further processing of the imaging surface layer. The sheet 64 is then usable as a hard copy reproduction of the image information that modulated the scanning beam 42 in FIG. 2.

Alternatively, as illustrated in FIG. 4D, the supporting section 15 is not separated from the imaging surface layer. The receiver sheet 64 thereby acquires not only the imaging surface layer 14 but also the particular attributes or characteristics of the supporting section. One preferred attribute is abrasion resistance, as may be provided by a supporting section composed of transparent plastic film. Other examples of increased functionality are greater conductivity or resistivity respectively provided by a metallized or insulating section; or rigidity, thermal stability, and other attributes afforded by materials selectable from the known art.

With reference to FIGS. 5 and 6, one may now appreciate that according to the invention, the imaging surface layer 14 is composed of a thermoplastic material that may be heated to effect a reversible transition from a state supportive of marking particles to a state permeable by marking particles. The contemplated thermoplastic material is thus transformable to a permeable state if heated beyond its transition temperature, but will resolidify if allowed to cool below the transition temperature. The thermoplastic material may be selected for its absorptivity of infrared radiation, e.g., its formulation may include an infrared-absorbing dye, whereupon an applied beam of infrared radiation will cause localized heating. The imaging surface layer 14 is otherwise transparent with little absorption or scattering at other light frequencies.

It is contemplated that at room temperature the imaging member 10 is preferably flexible and film-like. Accordingly, the supporting section 15 is preferably composed of a flexible dielectric material that is dimensionally and thermally stable, such as plastic film or paper. For some applications, the supporting section would be composed of a material which allows optical transmission of light without inducing significant aberration. Some plastic film base materials are known for such use; one suitable formulation is KODAK ESTAR TM film base available from Eastman Kodak Company. In other applications, for example in lithography, the supporting section may take the form of a non-transparent, rigid plate.

Two embodiments of the imaging member 10 will further exemplify the invention. In the imaging member 10A of FIG. 5, the supporting section 15 is composed of a transparent film base 15A having a transparent conductive electrode layer 16 and an optional release layer 18. The imaging member 10A may be positioned on a support 19. In various applications the support 19 may be in the form of a drum, web, or plate that is transparent or conductive, or both.

The electrode layer 16 is a thin, uniformly conductive coating on the film base 15A applied by processes known in the art. The layer 16 is preferably a transparent layer that is connectable to the bias voltage supply 22 illustrated in FIGS. 1–3. An electrostatic potential may thus be established between the marking particle layer 24 and the electrode layer 16.

The release layer 18 is composed of a known material usable for enhancing the aforementioned separation of the imaging surface layer 14 from the support 15. Such a material may be a polycrystalline wax, for example. The imaging surface layer 14 may be formulated such that it is separable from the supporting section 15 without such a release layer. If the imaging member 10 as a whole is to be transferred to the receiver means 60 or sheet 64, the release layer 18 can be omitted.

The imaging surface layer 14 need not be formulated to be non-absorptive of infrared radiation. Another component (such as the marking particle layer 24, the conductive layer 18, the film base 15A, or the support 19) is then formulated to be infrared-absorptive, such that the scanning beam 42 will cause localized heating in the respectively absorbent medium or layer. Heat is thereby conducted from such medium or layer to the imaging surface layer 14 to cause the aforementioned transition to the permeable state.

The imaging surface layer 14 may be uniformly and generally thermally-biased by heat generated by the support 19 to a temperature slightly below the transition temperature. Only a relatively small amount of localized heat is then required to effect the localized transition of the thermoplastic material to the permeable state that was described with respect to FIG. 2. Thermal biasing can also be used to aid the separation of the imaging surface layer 14 from the imaging member 10 that was described with respect to FIG. 4B.

As shown in FIG. 6, imaging member 10B is preferred for use in applications wherein the imaging member is supported by a conductive support 19, such as a metallic drum. The electrode layer 16 (see FIG. 5) is omitted, and connections otherwise made to the electrode layer 16 are made to the support 19.

Figure 7:
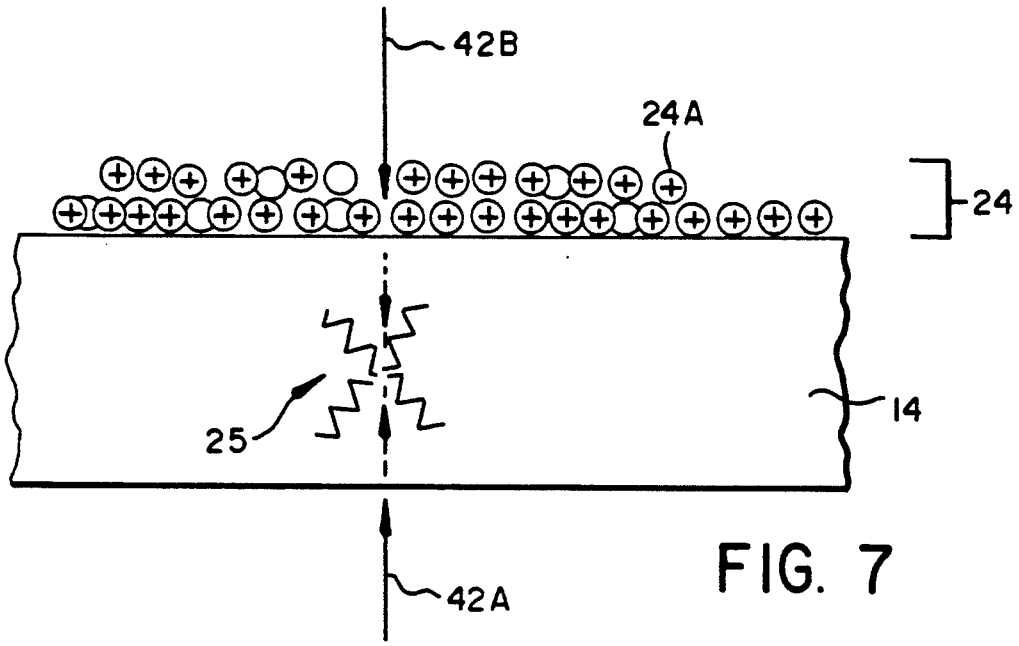
FIG. 7 is a side sectional view, in greater detail, of the exposed portion of the imaging member of FIG. 2.
Figure 8:
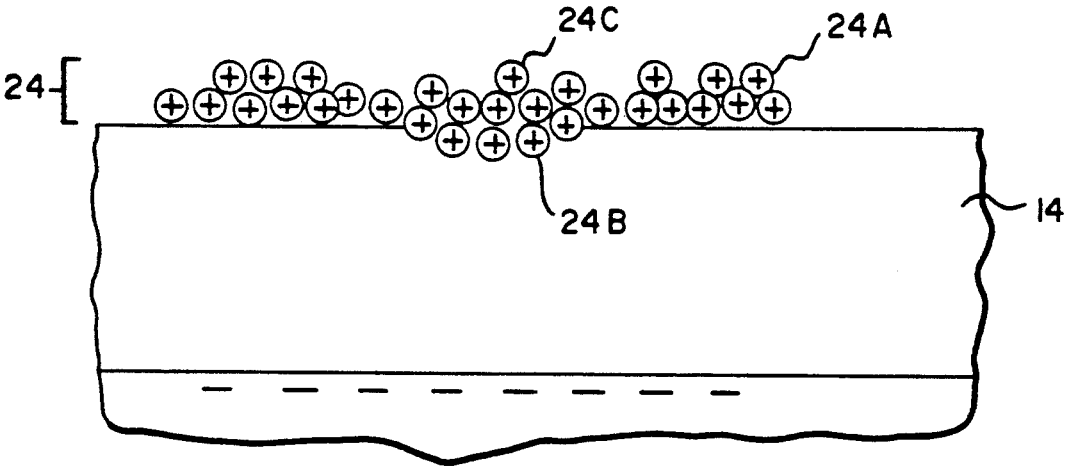
FIGS. 8 and 9 are side sectional views of the exposed portion of the imaging member of FIG. 7 after exposure and cleaning, respectively.
Figure 9:
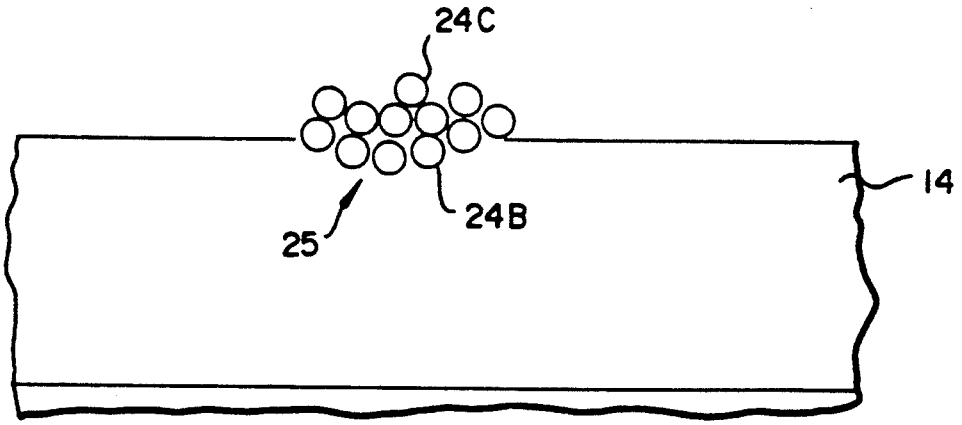

With reference to FIGS. 7, 8, and 9, in succession, the contemplated marking particle migration will be better understood. Preferably, when achievable, the marking particle layer 24 is a monolayer. However, as shown in FIG. 7, the marking particle layer 24 will in practice be composed of several layers of individual charged marking particles 24A. Each particle 24A is charged to a polarity opposite to that of the electrode layer 16 or the support 19 of FIGS. 5 and 6. Accordingly, the particles are attracted to the imaging surface layer 14.

The imaging member 10 is selectively exposed to heat-inducing energy, as may be provided by a laser beam 42A or 42B, in an imagewise pattern. The applied energy will heat selected portions of the imaging surface layer so as to be transformed to a permeable state. Thus, upon localized heating of the imaging surface layer 14, a pixel 25 of the imaging surface layer 14 is transformed. The addressed particles 24A, i.e., those that immediately superpose the pixel 25, migrate into the imaging surface layer 14 due to the aforementioned electrostatic attraction.

The beam scanning rate and intensity are chosen such that the beam moves onward to heat another pixel in the imaging surface layer. The heat in each pixel 25 soon dissipates, and the pixel 25 returns to a non-permeable state; particle migration stops accordingly. As shown in FIG. 8, the migrated marking particles 24B are either partially or totally embedded in the imaging surface layer.

It is contemplated that a selectable amount of induced heat may cause the addressed particles to melt slightly and thus be tacked together. Upon cooling, the embedded particles 24B and the immediately superposed particles 24C remain cohesive, in contrast to the surrounding particles 24A which are bound to the imaging surface layer only by the electrostatic force. It is further contemplated that a still-higher amount of applied heat may be selected to cause the addressed particles to melt and be partially or wholly mixed with the thermoplastic material in the pixel 25. Such an admixture of marking particles and thermoplastic imaging surface material would be limited to the addressed particles within the volume of the pixel 25. After cleaning, only the addressed particles 24B and 24C remain in or on the imaging surface layer 14.

Modulated laser scanning thereby produces an imagewise pattern of addressed marking particles 24B and 24C. By varying the beam scan rate (exposure duration), the beam pulse intensity, or both, one may select the number of particles in each pixel, the size of the pixel, and the marking particle admixture or density in the pixel.

Figure 10:
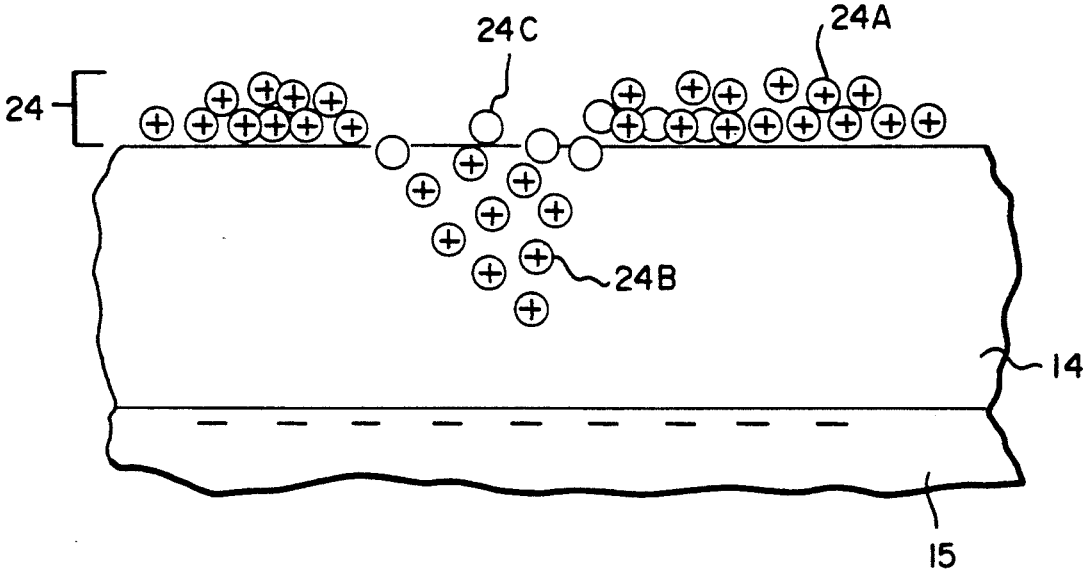
FIGS. 10 and 11 are side sectional views of another exposed portion of the imaging member of FIG. 7 after exposure and cleaning, respectively.
Figure 11:
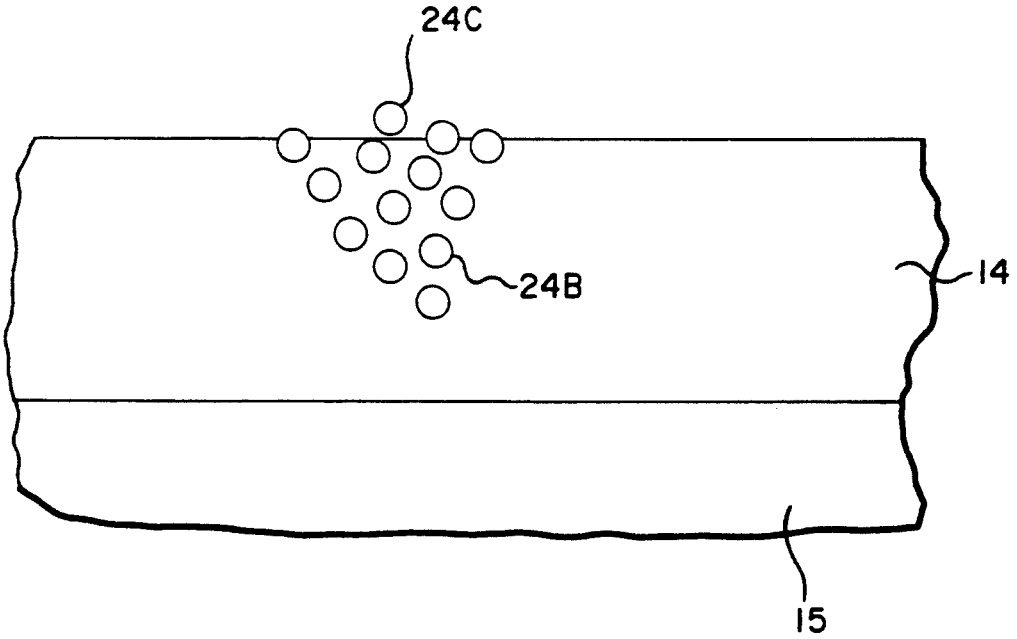

As may be seen in FIGS. 10 and 11, the strength of the electrostatic attraction, or the level of induced permeability, or both, may be sufficient such that the majority of the particles 24C that superpose a pixel 25 become fully embedded in the pixel. Thus, few or none of the overlying particles 24C, as shown in FIG. 11, remain outside the imaging surface layer 14. Any such superposed particles 24C nonetheless resist removal due to cleaning because of their tacky adhesion to the underlying embedded particles.

Figure 12:
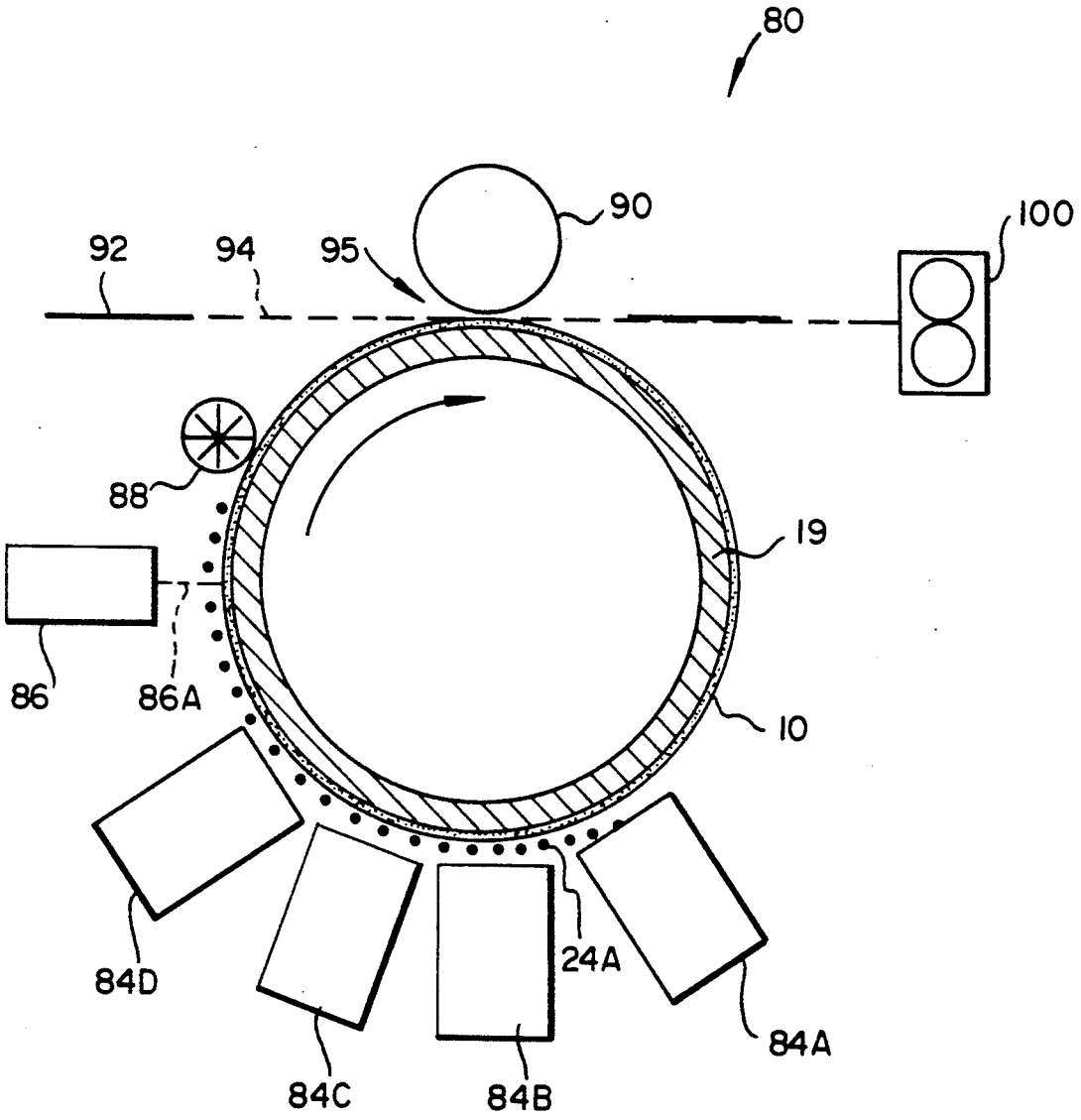
FIG. 12 is a side schematic view of an embodiment of an imaging system usable with the imaging member of FIGS. 5 or 6.

The contemplated imaging process is not limited to the creation of a single-color image reproduction by use of only one type of marking particles. It is contemplated that the aforementioned steps of marking particle deposition, exposure, and cleaning may be performed cyclically but with marking particles of differing types or colors in each cycle. As illustrated in FIG. 12, a multicolor imaging system 80 includes the imaging member 10 mounted on a support 19. The imaging member 10 uniformly contacts the outer surface of the support drum 19. If the drum is composed of a conductive material, imaging member 10B (which lacks an electrode layer 16) may be used. The image member 10 may be attached at its edges to the support 19 by known clamping means (not shown).

As the support 19 is rotated, an image frame receives a layer of one of a choice of (for example) cyan, magenta, yellow, or black colored marking particles 24A dispensed from one of the respective marking deposition means 84A, 84B, 84C, or 84D. In the addressing step, respective cyan, magenta, yellow, or black image data controls the appropriate scanning exposure by a modulated beam 86A from a laser scanner 86. Then, unaddressed marking particles are cleaned from the image frame by a cleaning means 88. The same image frame is rotated through the cycle of steps again, that is, to receive the next color choice of marking particles to be deposited, etc. For each separation color image in a multicolor composite image, the foregoing cycle is repeated.

The imaging surface layer 14 thereby accumulates a composite color image in one image frame. Without further processing, the imaging member 10 may be removed from the support 19 for use as a color transparency having a composite multicolor image.

The imaging member 10 may remain on the support 19 (which continues to rotate) such that the imaging surface layer 14 may be transferred and bonded to a heated receiver means 90 or to a heated receiver sheet 92. If the transfer is to a receiver sheet 92, a hard copy multicolor print is produced. Multiples of such prints are produced by continuous repetition of the foregoing process.

In a second multicolor process contemplated in the invention, a series of image frames may be prepared on the imaging member 10. The process includes the aforementioned cycle of marking particle deposition, imagewise exposure, and unaddressed particle cleaning of the imaging surface layer. However, each step is performed on not one, but a series of image frames on the imaging member 10. Thus, in the marking deposition step, two or more marking deposition means 84A, 84B, 84C, or 84D deposit a layer of uniform colored marking particles on respective image frames. In the scanning beam exposure step, respective cyan, magenta, yellow, or black image data controls the appropriate exposure of the image frames as they are rotated past the scanner 86. Lastly, unaddressed marking particles from all the image frames are cleaned by a cleaning means 88. The steps may overlap; i.e., the exposure step may begin on the first image frame of deposited marking particles as the second frame of marking particles is being deposited, and so on.

The imaging member 10 or 10A thereby accumulates a series of transferable colored image frames which, when superimposed, will form a composite multicolor image. As before, the imaging member 10 or 10A may be removed for use as a color transparency, or for examination of the sequential color separation images.

Alternatively, the support 19 may be rotated further such that in a series of transfer steps, the image frames are sequentially transferred to respective receiver sheets 92 to form a proof set of color separations. Such a set of hard copy images of differing colors or types of marking particles are suitable for proofing a multicolor image. Thus, a first receiver sheet is guided on path 94 through the nip 95 to receive only the first image frame of addressed marking particles. As the first receiver sheet 94 is passed to a fusing station 100, a second receiver sheet is guided on path 94 into registered engagement with the second image frame, and then to the fusing station. Subsequent imagewise patterns are similarly transferred to additional, respective receiver sheets. A set of fixed imagewise patterns on respective receiver sheets is generated. Multiple proof sets are produced by continuous repetition of the foregoing process.

In still another embodiment, repeated, synchronous rotation of the transfer drum 90 may be used to place one receiver sheet 92 into registered and repeated engagement with successive image frames in the imaging surface layer 14. The receiver sheet 92 then accumulates the transferred image frames in superposition. For example, a receiver sheet 92 may be fed to the nip 95 between a transfer drum 90 and the support 19. The receiver sheet 92 is retained on the rotating transfer drum 90 for engagement with the first, then second, etc. image frames in the imaging surface layer 14. The receiver sheet 92 is then released from the transfer means and guided to an optional fusing station 100 for complete fusing of the composite image, if necessary.

Because either the imaging surface layer 14 alone, or the entire imaging member 10 may be transferred in one of the above-described processes, a new imaging member may be needed on the support 19 to continue the imaging process. It is contemplated, therefore, that the support 19 may be equipped with an imaging member 10 internal feeder or spooling device (not shown). New image members 10 may be spooled from a continuous roll supply within the support 19 and severed from the support 19 when processing is complete. Such a spooling apparatus is known in the art. Alternatively, sheet feeding and attachment means (not shown) are known for feeding and attaching a series of individual imaging members 10 to the support 19. Each imaging member 10 may be fed and positioned by such means on the support 19.

Figure 13:
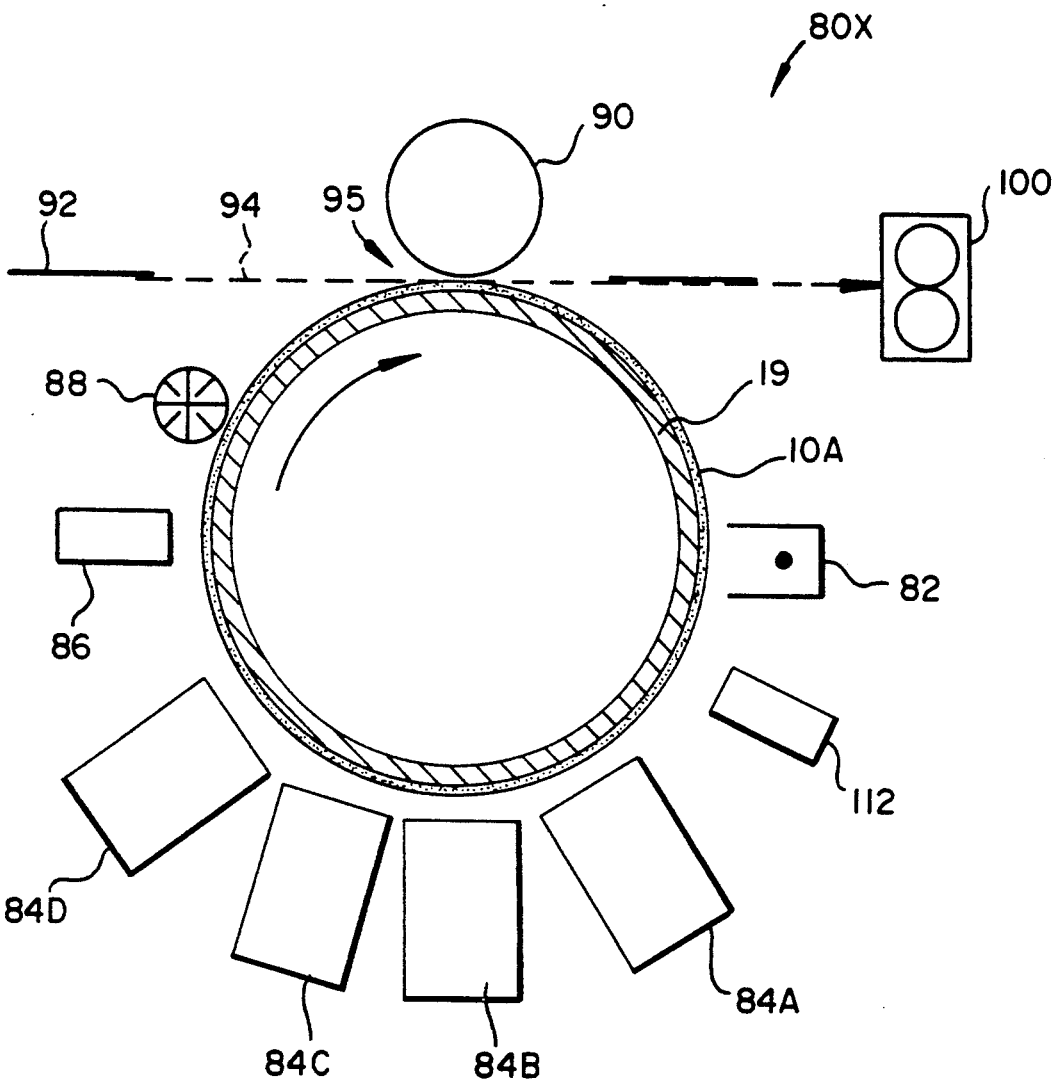
FIG. 13 is a side schematic view of an embodiment of a xeroprinting system usable with the imaging member of FIGS. 5 or 6.

With reference again to FIG. 6 and now to FIG. 13, the foregoing processing steps may be appreciated as usable in such a way as to generate a xeroprinting master. Accordingly, the imaging member 10A of FIG. 6, in particular, is specially formulated with known compounds such that either the imaging surface layer 14 or the film base 15A is photoconductive. Formulation of single or multiple layer photoconductor is known in the art. The imaging member 10B is mounted on a combined master-making and xeroprinting system 80X, which is constructed much like the imaging system 80 already discussed with respect to FIG. 12.

In a first, or master-making, mode of the system 80X, the imaging member 10A is first processed on system 80X in the fashion described with respect to system 80 of FIG. 12 to receive an imagewise pattern of marking particles. In this instance, however, the marking particles are especially selected as being light-opaque. The processed imaging member 10A is then transferred to the transfer drum 90 from the support 19. The film base 15A, which in this case is photoconductive, thereby becomes the outer surface of the transfer drum 90.

The transfer drum 90 and imaging member 10A may then be removed and relocated as a unit to a remote xeroprinting system, where the processed imaging member 10A is usable as a xeroprinting master. That is, the imagewise pattern of opaque marking particles in the processed imaging surface layer 14 may be utilized as an exposure mask for selective light exposure of the photoconductive film base 15A. (Alternatively, the processed imaging member 10 may also be removed from the drum 90 and used alone as a master).

Mask-based xeroprinting is known in the art and, therefore, will be related only briefly here. In such a remote xeroprinting system, the film base 15A is first uniformly charged, and light is directed through the areas in the imaging member that are not obscured by the imagewise pattern of thermalized marking particles. The charge on the film base 15A is dissipated by the light exposure not masked by the marking particles, thus leaving a latent image charge pattern for development with an influx of developer. The developed image is then transferred to a receiver and fixed at a fusing station.

The imaging system 80X may also be adapted for xeroprinting. The imaging member 10A may be processed, as described in the above, to become a xeroprinting master having one or more image frames of opaque particles. However, in this application the imaging surface layer 14 is photoconductive and the imaging member 10A is retained on the support 19. With continued rotation, the imaging member 10A is uniformly charged at a charger 82. Light emitted from a light source 112 is blocked from reaching the underlying portions of the imaging surface layer 14 in the areas obscured by marking particles. The charge on the imaging surface layer 14 is lessened or grounded by the light exposure not masked by the marking particles. The imagewise differential in charge constitutes an electrostatic latent image which is developable with colored marking particles. Thus, with further rotation of the support 19, each latent image is developed with marking particles by a respective particle deposition means 84A, 84B, 84C, or 84D.

Each developed image is rotated to meet a receiver sheet 92 fed in synchronism into the nip 95 with the rotation of the support 19. The series of developed images are thus transferred to a respective series of receiver sheets 92 to form a hard copy set of images. If a composite print is desired, only a single receiver would be fed in synchronism into the nip 95 to receive a first developed image. The receiver would be retained on the transfer drum 90 and returned to the nip 95 with the approach of a second developed image, which would be transferred in superposition onto the first developed image to create a composite image. Additional developed image transfers may be made in a similar fashion, whereupon the receiver 92 is passed to the fusing station 100 for fixing the composite image. A large number of high-resolution multicolor prints may, for example, be provided at very high speed in the foregoing process.

The invention has been described in detail with particular reference to preferred embodiments thereof, but it will be understood that variations and modifications can be effected within the spirit and scope of the invention. For example, it is contemplated that other types of particles may be substituted for the marking particles used in the above-described embodiments. Opaque magnetic particles may be advantageously used to provide machine-readable images in the imaging surface layer. Luminescent, radioactive, polarizing, or photoconductive marking particles may be used to create imagewise patterns having respective characteristics in the imaging surface layer. The use of conductive particles is also contemplated for creating electrically-conductive traces, capable of carrying electromagnetic signals, in the imaging surface layer 14.

What is claimed is:

1. A method of migration imaging, comprising the steps of:

providing an imaging member having a thermoplastic imaging surface layer and a support layer;

depositing marking particles on the imaging surface layer;

establishing an electrostatic attraction between the marking particles and the support layer;

imagewise exposing the imaging member to heat-inducing energy to transform exposed portions of the imaging surface layer from a state impermeable by the marking particles to a state permeable to such marking particles, whereby in accordance with the electrostatic attraction, those marking particles that overlie the exposed portions of the imaging surface layer migrate into the imaging surface layer in an imagewise pattern; and removing the nonmigrated marking particles.

2. The method of migration imaging of claim 1, wherein the exposure step causes a tacking together of at least a portion of the migrated particles.

3. The method of migration imaging of claim 1, wherein the exposure step causes a mixing of at least some of the migrated marking particles in the imaging surface layer.

4. The method of migration imaging of claim 1, further comprising the step of thermally biasing the imaging surface layer to a temperature slightly below the layer's transition temperature.

5. The method of migration imaging of claim 1, wherein the exposure step comprises the steps of:

modulating a heat-inducing light beam in an imagewise fashion;

scanning the modulated light beam onto the imaging member; and providing relative movement between the scanning beam and the imaging member.

6. The method of migration imaging of claim 5, wherein the heat-inducing light beam is directed to the marking particle layer to cause selective heating thereof.

7. The method of migration imaging of claim 1, further comprising the step of attaching the imaging surface layer to a receiver.

8. The method of migration imaging of claim 1, further comprising the step of subjecting the imaging surface layer generally to heat.

9. The method of migration imaging of claim 8, wherein the step of attaching the imaging surface layer comprises the steps of:

releasing the imaging surface layer from the imaging member; and transferring the imaging surface layer from the imaging member to the receiver.

10. The method of migration imaging of claim 9, further comprising the step of fusing the imaging surface layer to the receiver.

11. A method of migration imaging, comprising the steps of:

providing an imaging member having a thermoplastic imaging surface layer and a support layer;

depositing marking particles on the imaging surface layer;

establishing an electrostatic attraction between the marking particles and the support layer;

modulating a heat-inducing light beam according to an image to be recorded;

scanning the modulated light beam on the imaging member to imagewise transform exposed portions of the imaging surface layer from a state impermeable by the marking particles to a state permeable to such marking particles, whereby in accordance with the electrostatic attraction, those marking particles that overlie the scanned portions of the imaging surface layer migrate into the imaging surface layer;

removing the nonmigrated marking particles; and attaching the imaging surface layer to a receiver.

12. The method of migration imaging of claim 11, wherein the step of attaching the imaging surface layer comprises the steps of:

releasing the imaging surface layer from the imaging member; and transferring the imaging surface layer from the imaging member to the receiver.

13. A method of migration imaging, comprising the steps of:

providing an imaging member having a thermoplastic imaging surface layer and a support layer;

providing a color separation image in the imaging surface layer according to the steps of:

a. depositing marking particles of a selected color on the imaging surface layer, b. establishing an electrostatic attraction between the marking particles and the support layer, c. modulating a heat-inducing light beam according to color separation data, d. scanning the modulated light beam on the imaging member to imagewise transform exposed portions of the imaging surface layer from a state impermeable by the marking particles to a state permeable to such marking particles, whereby in accordance with the electrostatic attraction, those colored marking particles that overlie the scanned portions of the imaging surface layer migrate into the imaging surface layer, and e. removing nonmigrated colored marking particles; and repeating steps (a) through (e) to provide a plurality of color separation images in respective image frames in the imaging surface layer.

14. The method of migration imaging of claim 13, further comprising the step of attaching to a receiver at least one of the portions of the imaging surface layer corresponding to a color separation image.

15. The method of migration imaging of claim 14, further comprising the step of superposing a plurality of color separation images onto the receiver to provide a composite color image.

16. A method of producing a multicolor image on an imaging member which includes a thermoplastic imaging surface layer overlying a support layer, said method comprising the steps of:

a. depositing on the imaging surface layer marking particles of a first color;

b. establishing an electrostatic attraction between the colored marking particles and the support layer;

c. imagewise exposing the imaging member to transform exposed portions of the imaging surface layer from a state impermeable by the colored marking particles to a state permeable to such colored marking particles, whereby in accordance with the electrostatic attraction, those colored marking particles that overlie the exposed portions of the imaging surface layer migrate into the imaging surface layer;

d. removing nonmigrated marking particles; and e. repeating steps (a) through (d), each time using different colored marking particles, to provide a multicolor image in the imaging surface layer.

17. The method of migration imaging of claim 16, further comprising the step of attaching to a receiver the imaging surface layer.

* * * * *